US006459350B1

(12) United States Patent
Goseberg

(10) Patent No.: US 6,459,350 B1
(45) Date of Patent: Oct. 1, 2002

(54) DIODE-SPLIT HIGH-VOLTAGE TRANSFORMER

(75) Inventor: Walter Goseberg, Neuenrade (DE)

(73) Assignee: Thomson Licensing SA, Boulogne Cedex (FR)

( * ) Notice: Subject to any disclaimer, the term of this patent is extended or adjusted under 35 U.S.C. 154(b) by 0 days.

(21) Appl. No.: 09/460,136

(22) Filed: Dec. 13, 1999

(30) Foreign Application Priority Data

Jan. 5, 1999 (DE) ..... 199 00 111

(51) Int. Cl.[7] ..... H01F 27/30
(52) U.S. Cl. ..... 336/185; 336/170; 336/198
(58) Field of Search ..... 336/182, 185, 336/222, 223, 207, 208, 198, 170

(56) References Cited

U.S. PATENT DOCUMENTS

| | | | | | |
|---|---|---|---|---|---|
| 3,947,749 | A | * | 3/1976 | Kimura et al. | 336/182 |
| 4,204,263 | A | * | 5/1980 | Onoue | 363/68 |
| 4,272,814 | A | * | 6/1981 | Nakokhin et al. | 363/129 |
| 4,525,691 | A | * | 6/1985 | Kameya | 333/139 |

FOREIGN PATENT DOCUMENTS

| | | |
|---|---|---|
| DE | 3741556 | 6/1988 |
| DE | 4039373 | 6/1992 |
| DE | 19543573 | 5/1997 |
| DE | 19728875 | 1/1999 |
| DE | 19835639 | 2/1999 |
| EP | 0529418 | 8/1992 |
| EP | 0735552 | 11/1998 |
| EP | 0729160 | 5/1999 |
| WO | 98/03882 | 1/1999 |

* cited by examiner

*Primary Examiner*—Lincoln Donovan
*Assistant Examiner*—Tuyen Nguyen
(74) *Attorney, Agent, or Firm*—Joseph S. Tripoli; Harvey D. Fried; Joseph J. Kolodka

(57) ABSTRACT

The invention specifies a diode-split high-voltage transformer having a core, a primary winding and a high-voltage winding, which is arranged in chambers of a coil former, in which the chambers with the high-voltage winding lie below the primary winding, a conductive coating is arranged on the surface of the inner cavity of the coil former, and by virtue of a corresponding arrangement and wiring of the chambers, oscillations arising during operation in the high-voltage transformer induce capacitive currents on the conductive coating, the sum of which capacitive currents results approximately to zero. This can be achieved, for example in that by virtue of a symmetrical arrangement and wiring of the chambers with regard to the diodes, the oscillations induce capacitive currents on the conductive coating which occur in pairs with the same amplitude but in antiphase and thereby cancel one another out. In particular by virtue of an identical bottom thickness and approximately identical numbers of turns for all the chambers, the capacitive currents occur with a quantized amplitude, with the result that the values thereof can be defined in a simple manner since the stray capacitances are identical for all the chambers. This arrangement enables the earth connection to be omitted yet the screening effect of the conductive coating to be preserved.

10 Claims, 4 Drawing Sheets

DIODE-SPLIT HIGH-VOLTAGE TRANSFORMER

BACKGROUND

The present invention is based on a diode-split high-voltage transformer having a core, a primary winding and a high-voltage winding, which is arranged in chambers of a coil former. The structure of a high-voltage transformer of this type and also the way in which these chambers are wound are explained for example in EP-B-0 529 418.

The high-voltage transformer of a television set or computer monitor is a relatively expensive component, so that it is desirable to simplify its production, but without reducing its operational reliability. The patent application PCT/EP 98/03882, published after the priority date, has already specified a high-voltage transformer in which the high-voltage winding lies below the primary winding, between primary winding and core, whereby this becomes considerably more compact, lighter and more cost-effective. In order to avoid high-voltage flashovers and corona effects, this transformer has an insulation, for example a conductive coating, between the coil former and the core.

It is furthermore desirable for the high-voltage transformer to emit as far as possible no interference radiation, since, due to the high integration level of semiconductor circuits, the chassis of a television set has become very compact in the meantime and irradiation of the tuner circuit is thus possible. In this case, it is particularly diode-split high-voltage transformers that are problematic, since their high-voltage winding is on the outside and has no screening at all, or screening is very complicated and problematic. Measures for reducing this interference radiation or the undesirable oscillations are disclosed for example in EP-A-0 735 552 and EP-A-0 729 160.

The object of the present invention, therefore, is to specify a diode-split high-voltage transformer of the type mentioned in the introduction which is very compact and at the same time has good screening of the interference radiation.

BRIEF SUMMARY OF THE INVENTION

The diode-split high-voltage transformer according to the invention contains a core, a primary winding and a high-voltage winding, the high-voltage winding lying below the primary winding, or within the primary winding with regard to the housing. In this case, the high-voltage winding is arranged in chambers of a coil former whose surface of the inner cavity between the coil former and the core is provided with a conductive coating, thereby avoiding corona effects. Corona effects are produced in particular if a high electric field is present in air or in air inclusions, whereby ozone is produced, which is chemically highly aggressive and destroys the coil former and/or insulation. The conductive coating makes it possible to completely screen the electric field between the high-voltage winding and the core, with the result that no air inclusions or air gaps with high electric fields occur between the conductive coating and the high-voltage winding during operating of the high-voltage transformer.

The conductive coating is advantageously a thin layer containing colloidal graphite. The said layer can be applied in a simple manner by spraying a liquid spraying agent, comprising colloidal graphite and adhesive in a solvent, on the inner wall of the coil former by means of a nozzle. The conductive coating may alternatively be a metallized film which bears tightly on the inner wall of the coil former, or may be formed by potting the interspace between the core and the coil former with a conductive material. Further details concerning the conductive coating are specified in publication No. WO 99/03118, to which reference is hereby made.

The diodes of the high-voltage transformer are situated, in particular, not between or above the chambers with the high-voltage winding, but outside the chambers, with the result that the primary winding, taking a corresponding insulating layer into account, can be arranged directly above the chambers and is tightly wound in such a way that the high-voltage winding is completely covered by the primary winding. As a result of this, together with the conductive coating on the underside of the coil former, outstanding screening is produced for the high-voltage winding. It is appropriate, moreover, at least in the case of high-voltage transformers having two and four diodes, to connect one outer chamber to earth and to provide the other outer chamber as a high-voltage connection, with the result that the high-voltage transformer is also completely screened laterally, and to the top and bottom in the case of an upright design.

For the screening effect of the conductive coating, the latter should be earthed or connected to a constant electrical potential. It has been shown, however, that the thin electrical coating cannot be contact-connected to a metallic conductor without problems, since the said conductor can only be clamped on and not soldered, and the conductor only enables contact at points, or only a very small surface of the conductive coating is contact-connected. Since the conductive coating has, in particular, a high impedance in order to avoid eddy currents, the contact point to the earth connection can be destroyed by compensating currents. A measurement of the resistance across the conductive coating in the length of the coil former yields resistances of between 20 kohms and 2 Mohms, for example, depending on the design.

This earth connection can be avoided, however, if the chambers are arranged and wired to the diodes in such a way that the oscillations which arise during operation of the diode-split high-voltage transformer, in particular in the blocking phase of the diodes, induce capacitive currents on the conductive coating, which currents mutually cancel one another out, in other words the sum of these currents is zero. This can be achieved for example in that in the chambers the interference oscillations occur with identical amplitudes but in antiphase, and the capacitances between the chambers and the conductive coating are identical, with the result that the capacitive currents on the conductive coating compensate for one another. It is preferable to use an even number of chambers which all have an identical number of turns or at least an identical number of turns in pairs, with the result that the oscillations occur with quantized amplitudes. By virtue of the connections of the chambers to one another and to the diodes, oscillations with rising and falling amplitudes occur in one direction, with the result that the compensating currents of two respective chambers whose oscillations have the same amplitudes compensate for one another on the conductive coating.

In this case, a group of chambers in the centre of the high-voltage transformer has between two chambers a pulse-free connection which can advantageously be used for the focus connection of a picture tube. When the chambers are being wound, it is necessary in this case to ensure that chambers that are not yet filled are not straddled by wires, and the winding sense of the chambers is uniform.

Since the compensating currents cancel one another out, the interference radiation of the oscillations arising in the high-voltage winding is effectively screened, even if the earth connection for the conductive coating is omitted. The chamber bottoms have, in particular, the same thickness, for example 1 mm, with the result that the capacitances produced between the chambers and the conductive coating are identical. Final zero balancing of the output currents may furthermore be effected by different numbers of turns in individual chambers, whereby it is possible to reduce remaining pulse voltages from, for example, 40 V down to approximately 0 V. For monitoring purposes, it is possible in this case to measure the compensating current between the conductive coating and a reference-earth potential, for example earth. In the event of ideal balancing, the said current decreases to zero.

In the case of a high-voltage transformer having two diodes, the chambers with the high-voltage winding are subdivided into three groups by the two diodes, the highest pulse voltages occurring on both sides across the two diodes and the focus connection being routed out from the middle chamber and being free of pulse voltage.

In the case of high-voltage transformers having three and four diodes, a corresponding arrangement and wiring or winding of the chambers likewise make it possible to achieve the result that the capacitive currents on the conductive coating compensate for one another, with the. result that an earth connection can also be avoided in the case of these. In this case, the chambers are likewise preferably designed in such a way that oscillations occur with the same amplitude but in antiphase. These also contain a middle group with an even number of chambers, so that a focus voltage which is free of AC voltage can be routed out.

The present high-voltage transformer is thus excellently suited to recent television sets or monitor chassis since it operates practically with no interference radiation. It need no longer be feared that interference radiation will interfere with the tuner circuits. Contact-connection of the conductive coating, which is complicated with a reliable design and thereby increases the cost of the high-voltage transformer, can be avoided.

BRIEF DESCRIPTION OF THE DRAWINGS

The invention is explained below by way of example with reference to diagrammatic drawings, in which.

DESCRIPTION OF THE PREFERRED EMBODIMENTS

Figure 1:
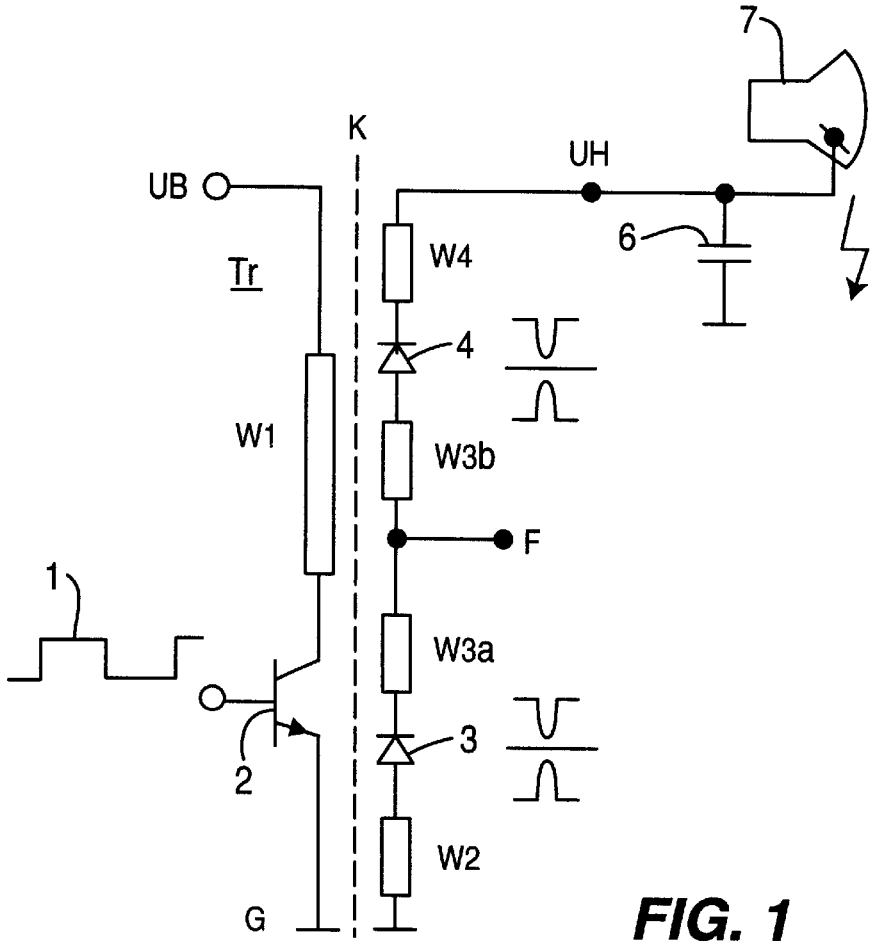
FIG. 1 shows a block diagram with a diode-split high-voltage transformer having two diodes for generating a high voltage for a picture tube.

FIG. 1 illustrates a diode-split high-voltage transformer Tr having a primary winding W1 and a high-voltage winding W2–W4 which is subdivided into partial windings W2, W3*a*, W3*b* and W4, a respective high-voltage diode 3 and 4, for the purpose of rectification, being interposed between the first and the second and the third and the fourth partial winding. A tap F for providing a high voltage for the focus electrode of a picture tube 7 is routed out between the second and the third high-voltage winding W3*a*, W3*b*. One end of the partial winding W2 is connected to a reference potential G, usually earth, and the high voltage UH which is routed out at a connection for the operation of the picture tube 7 is present at one end of the partial winding W5.

The high voltage is usually smoothed by cable capacitances of the connecting cable and capacitances in the picture tube 7, indicated here by the capacitance 6. This capacitance usually amounts to a number of nanofarads, so that the high voltage constitutes a DC voltage potential for interference pulses of the high-voltage transformer. One end of the primary winding W1 is connected to an operating voltage UB and the other end is connected to a switching transistor 2, which is switched on and off periodically by a drive signal 1. The high-voltage transformer furthermore contains a core K, usually an E/E or E/I ferrite core.

The switching transistor 2 is turned off in the short time of the horizontal line flyback. This results in a high pulse loading for the high-voltage transformer Tr, and this loading must be taken into account in the design of the said transformer. Since the rectifying diodes 3, 4 are connected between the partial windings of the high-voltage transformer in the arrangement according to FIG. 1, it is evident that the outer ends of the high-voltage winding are free of AC voltage since they are connected to the DC voltage potentials G and UH. Therefore, the pulsed loadings are principally applied to the partial windings adjacent to the diodes and are at a maximum, but in antiphase, at the connections of the diodes 3 and 4. The individual splitting of the pulse voltages is explained with reference to FIG. 3.

Figure 2:
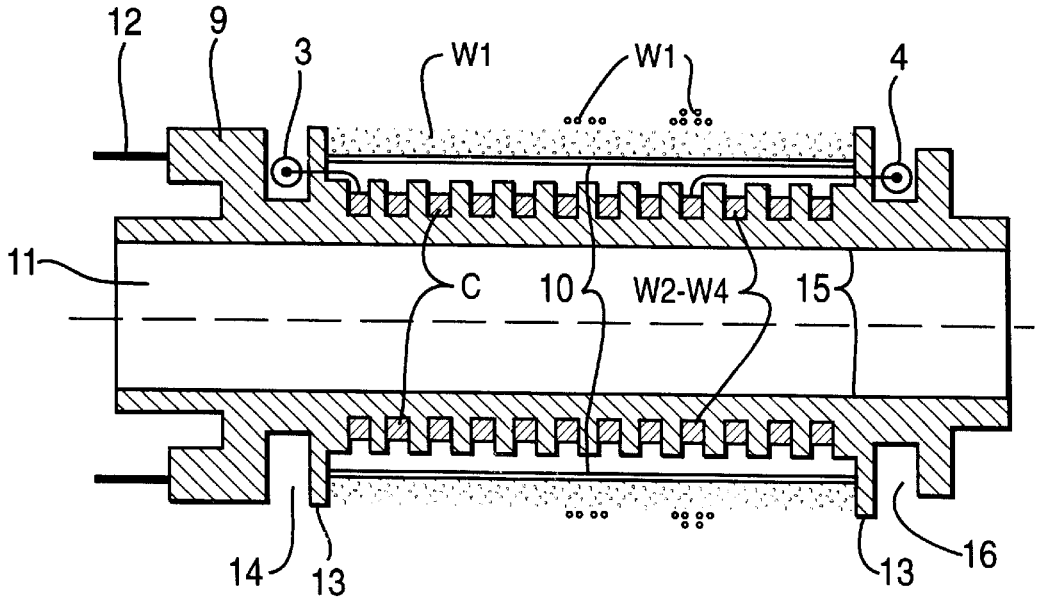
FIG. 2 shows a coil former with windings and two diodes for a high-voltage transformer.

FIG. 2 illustrates, in a sectional drawing, a coil former 9, which accommodates both the primary winding W1 and the high-voltage winding subdivided into the partial windings W2–W4 lying underneath the primary winding W1. The coil former 9 contains an axial inner cavity 11, which accommodates the ferrite core (not illustrated), and a multiplicity of chambers C, twelve in this exemplary embodiment, the bottom of which approximately has a thickness of 1 mm in the direction of the cavity and into which the partial windings W2–W4 of the high-voltage winding are wound. In this case, three adjacent chambers respectively correspond to one of the partial windings W2, W3*a*, W3*b* and W4.

An insulating layer 10, which consists of a number of layers of a sheet winding in this exemplary embodiment, lies above the chamber C. The primary winding W1 is wound in one or more tightly wound layers directly onto this insulating layer 10. In addition, auxiliary windings WH are applied to the primary winding W1 for the purpose of generating further DC voltages. Examples of practical wire thicknesses are 0.335 mm or more for the primary winding W1 and 0.05 mm of enamelled copper wire for the high-voltage winding.

As an alternative to the sheet winding, a plastic sleeve is also possible as insulating layer between the primary winding and the high-voltage winding, which can be pushed on over the coil former 9 with the high-voltage winding W2–W4. The primary winding can then be wound together with the auxiliary windings directly onto the plastic sleeve. By virtue of a corresponding arrangement of the diodes, as described in PCT/EP 98/03882, the entire coil former can be kept very compact even when a sleeve is used. The sleeve then lies in a positively locking manner over the chambers C of the high-voltage winding W2–W4 and covers the latter completely.

In this exemplary embodiment, at the chamber ends, the coil former 9 has lateral edges 13 for accommodating the sheet winding 10 and the primary winding W1. These raised parts are followed, towards the outside, by two further chambers 14, 16, which serve to accommodate the two high-voltage diodes 3, 4. The diodes 3, 4 are connected to the partial windings W2–W4 of the high-voltage winding via the wires of the corresponding windings.

As a result of this design, the chambers C with the high-voltage winding are completely covered by the primary winding W1, separated by an insulating layer, with the result that the low-impedance primary winding W1 implements effective screening of the high-frequency, intense interference radiation which is produced by the switching of the switching transistor 2 and is stepped up by the transformation ratio of the numbers of turns of the primary winding W1 with respect to the high-voltage winding. If the diodes 3, 4 are in the off state, the interference oscillations are separated into different oscillations in each of the partial windings W2–W4, and the oscillation frequency in this case depends on the corresponding stray inductances and stray capacitances of each partial winding.

In this exemplary embodiment, the inner cavity 11 of the coil former 9, in which a limb of the core (not illustrated) is situated, is provided with a conductive coating 15 on its entire surface, which conductive coating may be earthed, for example by contact with the core. The conductive coating used may advantageously be a colloidal graphite layer which can be applied in a spraying process and has a high-impedance conductivity. By this means, the inherently unavoidable air-filled interspace between the ferrite core and the coil former 9 is screened against the high voltage, with the result that corona formation is completely suppressed by this measure. The conductivity of the coating is chosen such that eddy currents in the said coating are avoided.

The layer with the colloidal graphite can preferably be applied by means of a liquid spray which contains colloidal graphite and adhesive in a solvent and which additionally slightly dissolves the plastic of the coil former 9 in order to increase the adhesion. This spray can be applied in a simple manner, for example using a nozzle which sprays in the radial direction and is led through the cavity 11 of the coil former 9.

On its underside, the coil former 9 contains electrical connections 12 by which the high-voltage transformer is fixed directly on a circuit board. It will additionally be surrounded by a plastic housing (not illustrated) which is open towards the side of the connections, and be completely potted together with the latter by means of a synthetic resin composition.

The surface of the inner cavity 11 can, for example, also be provided with the conductive coating 15 by means of a metallized film, in particular plastic film. The metallized film is in this case wound in an overlapping manner between core and coil former and should nestle as tightly as possible with the metallized side on the surface of the inner cavity, so that corona effects are avoided. A low-impedance metal foil alone is not suitable since it would form a short-circuit winding. A metallized plastic film, for example aluminized Mylar does not form a short-circuit winding over the periphery even with overlapping. Also conceivable is the use of two sheets, for example a plastic film and a metal foil which are wound in an overlapping manner such that the metal foil does not have any electrical contact at the overlapping end. It is also possible to pot the remaining cavity between the core K and the coil former 9 with a material having a low conductivity.

Figure 3:
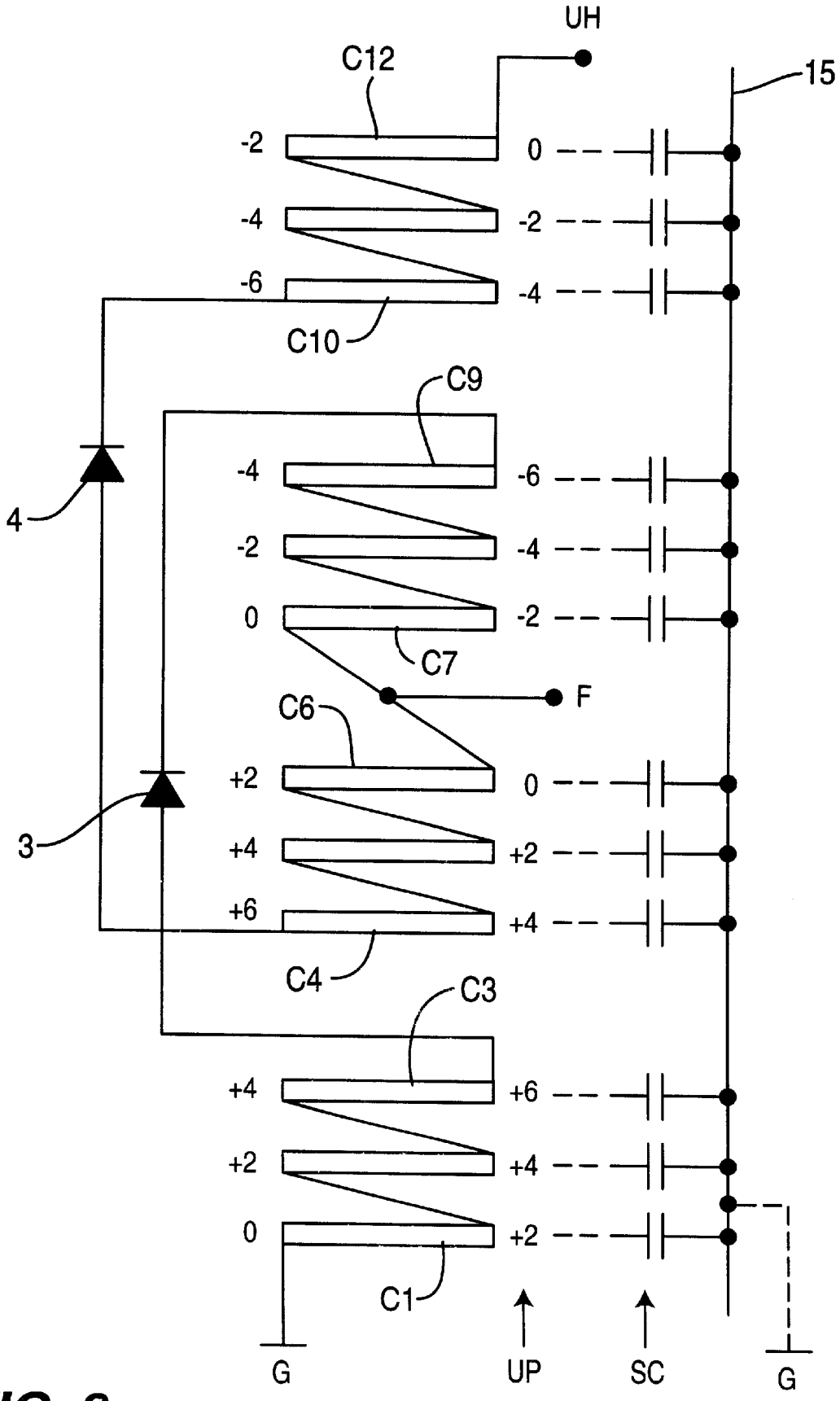
FIG. 3 shows the circuitry of the chambers for a high-voltage transformer having two diodes.

The structure and the circuitry of the high-voltage winding of FIGS. 1 and 2 is explained in more detail with reference to FIG. 3, which diagram-matically illustrates the windings in the chambers C1–C12 and also their circuitry, without the coil former 9. The first partial winding W2 contains the three chambers C1–C3, which are connected up serially, where the start of the chamber C1 is connected to earth G and the end of the chamber C3 is connected to the diode 3. The partial windings W3*a* and W3*b* are situated in the chambers C4–C6 and C7–C9, respectively, and are likewise connected serially. The partial winding W4 contains the chambers C10–C12, the connection for the high voltage UH being routed out from the end of the chamber C12. The start of the chamber C4 is connected to the cathode of the diode 4 and the end of the chamber C9 is connected to the anode of the diode 3. The anode of the diode 4 is connected to the start of the chamber C10.

In this exemplary embodiment, all the chambers contain approximately the same number of turns, which amounts to approximately 300, by way of example, given a high voltage to be generated of 24 kV. As a result of this symmetrical structure, the following conditions are produced for the pulse voltages UP: since the diodes 3, 4 are connected symmetrically with respect to earth G and the high voltage UH and also with respect to the centre of the high-voltage winding, the identical pulse voltages, which are approximately +/−6 $kv_{pp}$ given a high voltage of 24 kV, are present across the two diodes. These voltages are correspondingly present at the chambers C3, C4, C9 and C10. Since the chambers are connected up serially, the voltage for the remaining chambers is reduced correspondingly according to the voltage divider principle, in which case, in this exemplary embodiment, a pulse voltage of 2 $kv_{pp}$ is present per chamber in accordance with the winding between the bottom of the chamber and the top of the chamber. The pulse voltages UP +2,+4 and +6 kV are therefore present at the chamber bottom of the chambers C1–C3, since the diode 3 is connected to the chamber bottom of the chamber C3. In this case, these chambers are wound in the order C3, C2, C1, with the result that the winding end of the chamber C1, the top of the chamber, is connected to earth G.

The pulse voltages 0, −2 and −4 kV are present at the chamber bottoms of the chambers C12, C11, C10, since these are wound beginning with the chamber C12 and the wire end of the chamber C12 is routed out to the high-voltage connection UH and the wire end of the chamber C10 for the connection to the diode 4. In the case of the chambers C4–C9, corresponding pulse voltages of +4–31 6 kV with a difference voltage of 2 kV per chamber are established at the bottoms of the chambers, since the chamber bottom of the chamber C9 is connected to the cathode of the diode 3 and the winding end of the chamber C4 is connected to the anode of the diode 4. The connection between the chambers C6 and C7 is free of pulse voltage and is therefore used for the focus voltage F.

The high-voltage winding is subdivided by the diodes 3, 4 as it were into groups C1–C3, C4–C9 and C10–C12, in each group the pulse voltages UP assuming quantized values in an ascending or descending sequence and an amplitude value of zero, which can be utilized for the focus connection, occurring in the or a middle group C4–C9.

The pulse voltages UP at the chamber bottoms of the chambers C1–C12 therefore produce the sum of zero. Since the thickness of the bottoms of the chambers towards the conductive coating 15 is chosen to be identical for all the chambers in this exemplary embodiment, the capacitances SC between the chamber windings C1–C12 and the conductive coating 15 are also all identical, disregarding fringe effects. The capacitive currents induced by the pulse voltages UP on the conductive coating 15 are therefore proportional to the quantized pulse voltages UP and therefore likewise produce the sum of zero. As a result of this, the chambers C1–C12 are screened by the conductive coating 15 just as effectively as if the latter were provided with an earth connection G. The latter can therefore be dispensed with.

Figure 4:
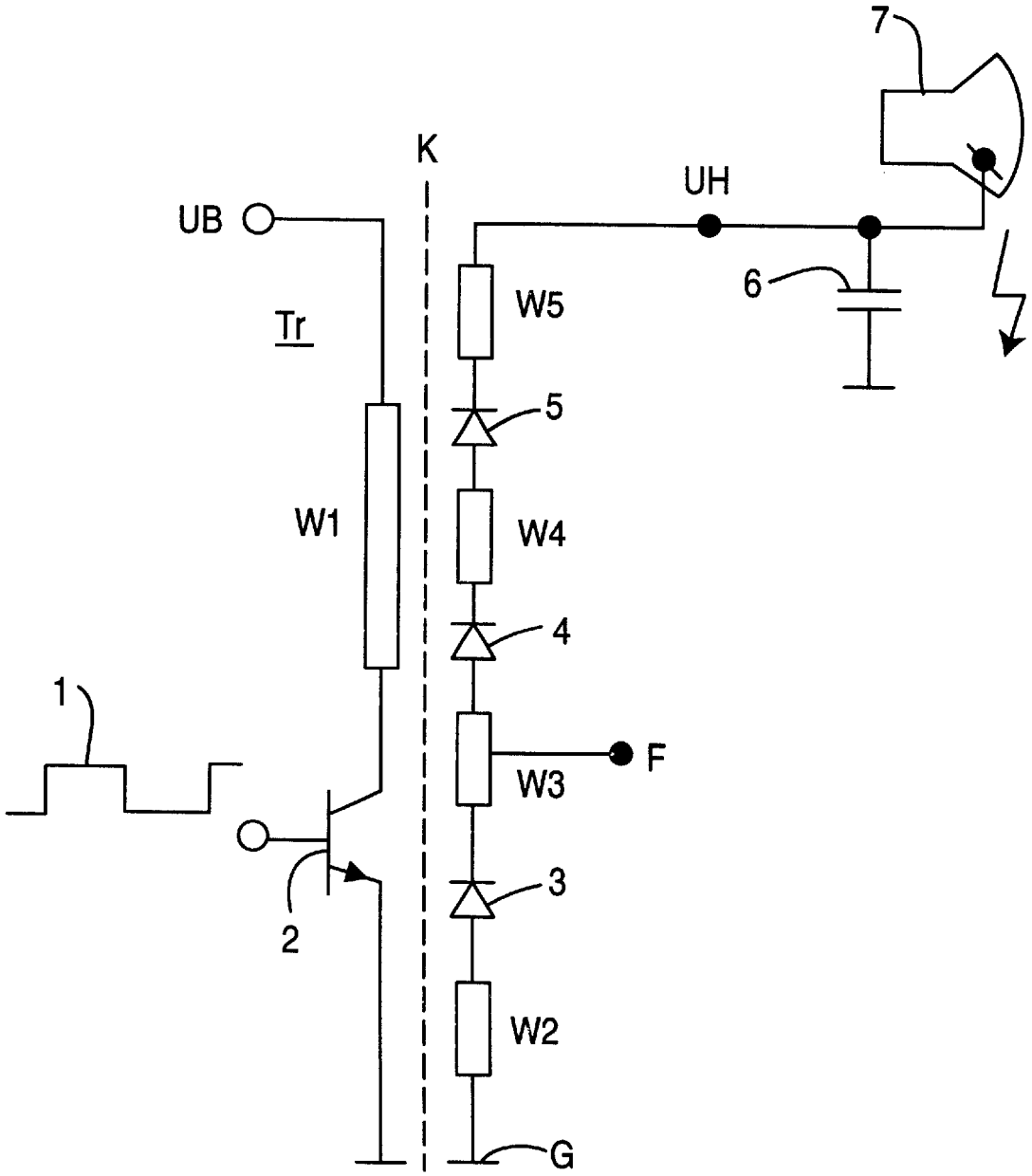
FIG. 4 shows a block diagram with a diode-split high-voltage transformer having three diodes for generating a high voltage for a picture tube.

The circuit of FIG. 4 illustrates a diode-split transformer having three diodes 3–5 which is constructed in a similar manner to the high-voltage transformer explained with reference to FIGS. 1 and 2. In the figures, therefore, identical concepts are provided with the same reference symbols. A respective diode 3, 4, 5 is arranged between the partial windings W2–W5 and the tap F for the focus electrode is in this case routed out from the partial winding W3, as explained below with reference to FIG. 5.

Figure 5:
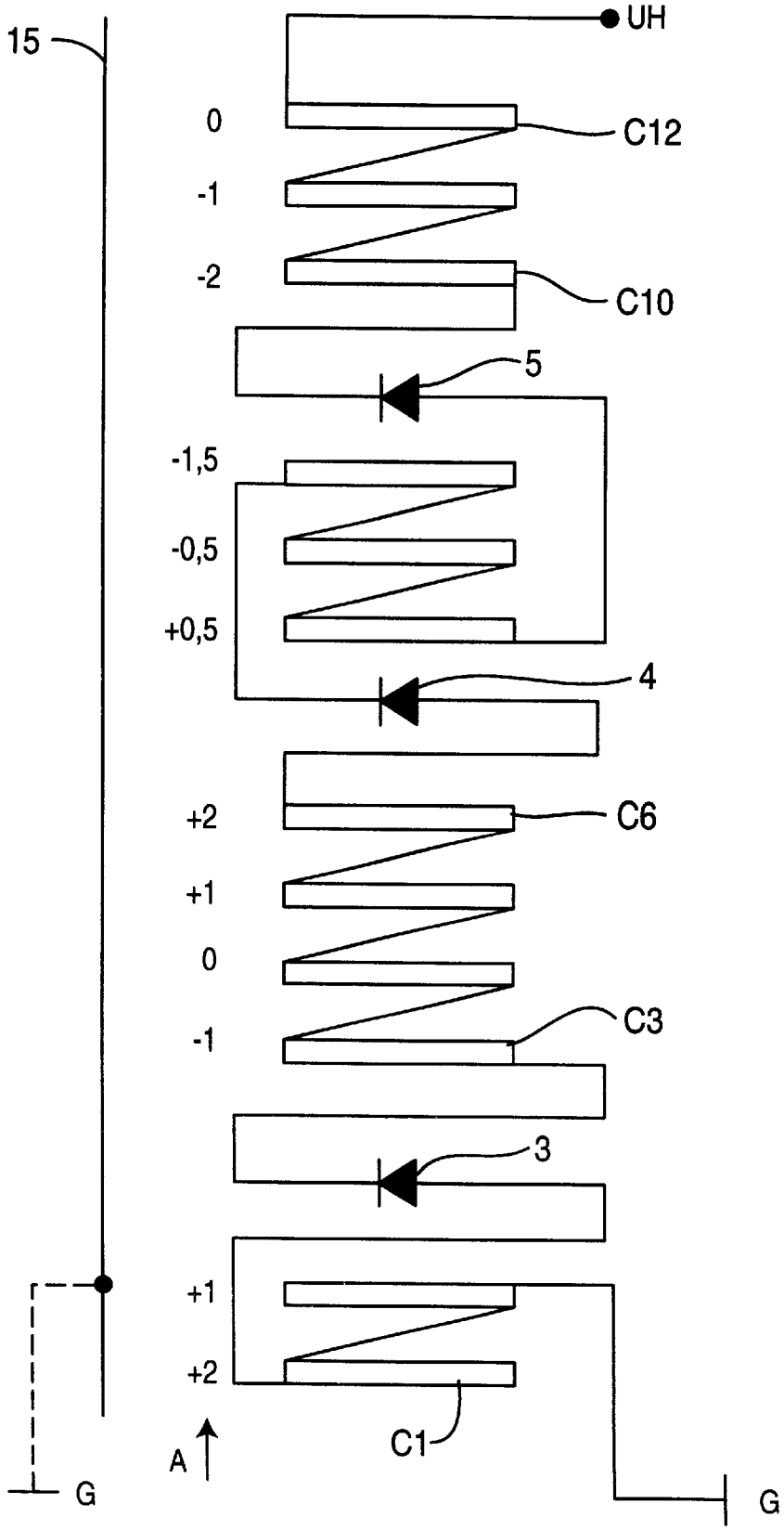
FIG. 5 shows the circuitry of the chambers for a high-voltage transformer having three diodes.

FIG. 5 shows a high-voltage winding having 12 chambers C1–C12 in accordance with the exemplary embodiment illustrated in FIG. 4, which is subdivided by diodes D3–D5 into four partial windings or groups of chambers C1–C2, C3–C6, C7–C9, C10–C12. By virtue of a corresponding arrangement and dimensioning of the chambers C1–C12 with regard to the diodes 3–5, quantized amplitude values A, from −2 to +2, are likewise produced here, and by virtue of a corresponding dimensioning of the parameters of the coil former, the capacitances between the bottom of the chamber and the conductive coating 15 are in each case identical for each chamber C1–C12, so that the quantized amplitude values A, as specified in FIG. 5, produce the sum of zero and the capacitive currents on the conductive coating 15 likewise cancel one another out. As a result of this, the earth connection G can also be omitted in this case. In this case, the chambers are wound beginning with the chamber C1 in an ascending order up to the chamber C12, all the connection wires for the diodes 3–5 being routed downwards, in the figure, so that all three diodes 3–5 in this case lie below the chamber C1.

For high-voltage transformers having more than three diodes, the coil former and the high-voltage winding can likewise be constructed in such a way that the sum of the capacitive currents on the conductive coating results in zero, so that these, too are screened by the conductive coating and are free of radiation. Due to relatively small asymmetries, for example fringe effects, specific chambers may, under certain circumstances, not produce exactly the desired amplitude values of the pulse voltages, thereby necessitating fine adjustments. This can be effected for example by these chambers having numbers of turns that are changed accordingly. This means that for these cases, too, the capacitive currents on the conductive coating can be reduced practically down to zero.

The structure used in the exemplary embodiment mentioned above, with an identical thickness of the bottoms of the chambers and an approximately identical umber of turns for all the chambers C1–C12, is not a necessary precondition for the induced capacitive currents on the conductive coating 15 to cancel one another out. By way of example, it is also conceivable for two chambers in each case to be constructed identically and arranged symmetrically with regard to the diodes in such a way that the capacitive currents on the conductive coating 15 in each case cancel one another out for these, for example in order to afford a better high-voltage strength for specific chambers. Further exemplary embodiments are likewise possible, the chambers having to be constructed and arranged in such a way that the sum of all the capacitive currents on the conductive coating 15 results in zero or the capacitive currents mutually compensate for one another.

The above-described embodiments of a diode-split high-voltage transformer are only by way of example; in particular, the high-voltage winding can also be subdivided into more than four partial windings if more than three diodes are used, and also into a different number of chambers C. Circuits of the kind illustrated in FIGS. 1 and 4 are likewise used in computer monitors.

What is claimed is:

1. A diode-split high-voltage transformer comprising a core, a primary winding, a high-voltage winding, a coil former with an inner cavity, in which said core is located, with chambers, in which said high voltage winding is arranged, and with a conductive coating being arranged on the surface of said cavity, said coil former with said high-voltage winding lying between said primary winding and said core, said high-voltage winding being subdivided by a first and a second diode into a first, a second and a third partial winding, two partial windings in each case being connected to one another by one diode, said first and said third partial winding having an identical number of chambers and said second partial winding between said first and third partial windings having an even number of chambers and a focus connection for a focus electrode of a picture tube, the start of said first partial winding being coupled to ground and the end of said first partial winding, in the winding direction, being connected to the end of said second partial winding via said first diode, and the start of said middle partial winding being connected via said second diode to the start of said third partial winding, and the end of said third partial winding being coupled to a high voltage terminal.

2. The high-voltage transformer according to claim 1, characterized in that, in the case of at least two chambers, the chamber bottoms have the same thickness and their windings have an identical number of turns.

3. The high-voltage transformer according to claim 1, wherein said focus connection is being routed out from the center of said second partial winding.

4. The high-voltage transformer according to claim 1, wherein said diodes are arranged laterally with respect to said chambers, and in that said primary winding completely covers said high-voltage winding.

5. A diode-split high-voltage transformer comprising a core, a primary winding, a high-voltage winding, a coil former with an inner cavity, in which said core is located, with chambers, in which said high voltage winding is arranged, and with a conductive coating being arranged on the surface of said cavity, said coil former with said high-voltage winding lying between said primary winding and said core, and said high-voltage winding being subdivided by three diodes into four partial windings, two outer partial windings and two inner partial windings, two partial windings in each case being connected to one another by one diode, the end of a first outer partial winding, in the winding direction, being coupled to ground and the start of said first partial winding being connected to the start of a first inner partial winding via a first diode, the end of said first inner partial winding being connected to the end of the second inner partial winding via a second diode, and the start of said second inner partial winding being connected to the start of said second outer partial winding via said third diode, the end of said second outer partial winding being coupled to a high voltage terminal.

6. The high-voltage transformer according to claim 5, wherein the number of chambers of said partial windings is two, four and twice three for said first, second, third and fourth partial windings, and said second partial winding has a focus connection for a focus electrode of a picture tube.

7. The high-voltage transformer according to claim 5, characterized in that, in the case of at least two chambers, the chamber bottoms have the same thickness and their windings have an identical number of turns.

8. The high-voltage transformer according to claim 5, wherein said focus connection is being routed out from the center of said second partial winding.

9. The high-voltage transformer according to claim 5, wherein said diodes are arranged laterally with respect to said chambers, and in that said primary winding completely covers said high-voltage winding.

10. A diode-split high-voltage transformer comprising a core, a primary winding, a high-voltage winding, a coil former with an inner cavity, in which said core is located, with chambers, in which said high voltage winding is arranged, and with a conductive coating being arranged on the surface of said cavity, said coil former with said high-voltage winding lying between said primary winding and said core, and said high-voltage winding being subdivided by diodes into two outer partial windings and at least one inner partial winding, two partial windings in each case being connected to one another by one diode, a first outer partial winding being coupled to ground and the remaining second outer partial winding being coupled to a high voltage terminal, the start of an inner partial winding, with regard to the winding direction, being connected to the start of said second outer partial winding via one of said diodes for a reverse winding sense, and an inner partial winding between said outer partial windings having an even number of chambers and a focus connection for a focus electrode of a picture tube, which is being routed out from the center of said inner partial winding.

* * * * *